United States Patent [19]

Fisher et al.

[11] 3,972,372

[45] Aug. 3, 1976

[54] EXRACTION OF HYDROCARBONS IN SITU FROM UNDERGROUND HYDROCARBON DEPOSITS

[76] Inventors: Sidney T. Fisher, 53 Morrison Ave.; Charles B. Fisher, 2850 Hill Park Road, both of, Montreal, Quebec, Canada

[22] Filed: Mar. 10, 1975

[21] Appl. No.: 556,544

[52] U.S. Cl. ..... 166/248; 165/45; 166/256; 166/303; 219/10.41; 219/10.57

[51] Int. Cl.[2] ..... E21B 43/24; E21B 43/25

[58] Field of Search ..... 166/60, 248, 256, 257, 166/258, 260, 261, 303; 299/4, 14; 75/29, 133; 219/10.41, 10.57; 266/1 R, 5 EI; 165/45

[56] References Cited

UNITED STATES PATENTS

| | | | |
|---|---|---|---|
| 849,524 | 4/1907 | Baker | 166/248 |
| 1,510,655 | 10/1924 | Clark | 166/60 X |
| 2,472,445 | 2/1945 | Sprong | 166/60 |
| 2,780,450 | 2/1957 | Ljungström | 166/60 X |
| 3,113,620 | 12/1963 | Hemminger | 166/259 X |
| 3,127,935 | 4/1964 | Poettmann et al. | 166/260 |
| 3,294,167 | 12/1966 | Vogel | 166/303 X |
| 3,379,248 | 4/1968 | Strange | 166/256 |
| 3,605,888 | 9/1971 | Crowson et al. | 166/248 |
| 3,848,671 | 11/1974 | Kern | 166/248 |
| 3,880,238 | 4/1975 | Tham et al. | 166/303 |

OTHER PUBLICATIONS

"AC Current Heats Heavy Oil for Extra Recovery", *World Oil* May 1970, pp. 83–86.

*Primary Examiner*—Stephen J. Novosad
*Assistant Examiner*—George A. Suckfield
*Attorney, Agent, or Firm*—R. H. Barrigar

[57] ABSTRACT

A method of extracting hydrocarbons in situ from an underground hydrocarbon deposit (such as petroleum or lignite). A selected part of the deposit is heated by electrical induction to temperatures high enough to drive off hydrocarbon fractions as gases or vapors, which are then collected. The deposit may be heated through a coking and cracking stage. The electrical induction heating is conveniently effected by passing alternating current through a conductive path encompassing that part of the deposit to be heated.

13 Claims, 5 Drawing Figures

EXRACTION OF HYDROCARBONS IN SITU FROM UNDERGROUND HYDROCARBON DEPOSITS

FIELD TO WHICH THE INVENTION RELATES

The present invention relates to a method of extraction of hydrocarbons from underground deposits.

BACKGROUND OF THE INVENTION

In northern Alberta are located what are popularly known as "tar sands" (and which probably would be more appropriately referred to as "bituminous sands") occasionally exposed at the surface of the ground but generally overlaid by soil to varying depths. The bituminous sands comprise a heavy percentage of quartz sand (say 80%), small amounts of clay, of the order of 5% water, and of the order of 15% bitumen by weight. The bituminous sand deposits are estimated to contain more than one million million barrels of oil.

For many years efforts have been made to recover the oil, and several processes have been proposed for the purpose. Many proposals have involved the mining of the sand and the extraction of the petroleum from the sand thereafter. The mining techniques and associated extraction techniques have generally involved intolerably high capital investments, energy expenditures, ecological damage, and extraction and refining costs.

Various methods have been proposed to extract the petroleum from the sands in situ without requiring the mining of the sands. Recognizing that most recoverable petroleum deposits have been located at much greater depths and therefore at higher temperatures and pressures than are to be found in the Alberta bituminous sands, engineers have proposed the artificial creation of similar conditions in the bituminous sands of Alberta. Alternating current applied across terminals embedded in a bituminous sand deposit for the purpose of the heating of a portion of the bituminous sand deposit by electrical conduction has not been successful, usually because of the formation of carbonized paths between the electrodes, limiting current flow to these paths. Since the thermal conductivity of the deposits is relatively low, the heating of paths of relatively small dimensions within a bituminous sand deposit has not been successful in raising the overall temperature of the deposit (or a sufficiently large volume thereof) to the desired value.

It has also been proposed to extract petroleum from underground bituminous sand deposits by forcing steam into the deposits and emulsifying the bitumen. The use of steam has required the generation at the surface of large amounts of process heat, and the problem exists that the steam cannot always be sufficiently confined to the particular portion of the deposit from which the petroleum is intended to be extracted, but rather tends to blow out of the deposit being treated. The high-temperature high-pH emulsions also tend to dissolve quartz and displace clay, with attendant flow and separation problems.

It has been proposed to burn a portion of the petroleum in situ so as to generate sufficient heat to raise the temperature of the remaining portion of the petroleum sufficiently to enable the petroleum to flow into suitable wells from which the petroleum may be extracted. Such methods have been generally unsatisfactory to date, and even if satisfactory would tend to waste a good deal of the stored energy of the underground petroleum through the burning process. Nuclear explosions have been advocated, but have not yet been experimentally tested, to realize much the same objective of increasing the heat and pressure within the underground deposit so as to enable at least a portion to be recovered. It is apparent however, that at least some of the petroleum would be carbonized by a nuclear explosion, and a significant portion or perhaps all of the petroleum that could be recovered in such a process (if the process were successful at all) would be contaminated by radioactivity.

In Colorado and other areas of the United States, there are large beds of oil shale. These oil shale deposits are sometimes exposed at the surface but generally are overlaid by other formations. Kerogen is entrapped within the oil shales. Again, the extraction of oil from the shales has not, to date, been commercially attractive because of the formidable problems encountered in separating oil from shale.

Finally, in many parts of North America, substantial underground lignite deposits exist. No economically attractive method is known for extracting the lignite. Mining has in the overwhelming majority of cases proved to be impossible or extremely hazardous because of the serious risk of explosion of oil or gas commonly found associated with the lignite deposits. The lignite deposits constitute a major potential hydrocarbon reserve, and a need exists for a safe and satisfactory method of recovery of the hydrocarbons.

SUMMARY OF THE INVENTION

The invention is a method of extraction and processing in situ of underground hydrocarbons located in an underground hydrocarbon or hydrocarbon-bearing deposit which comprises the heating by electrical induction of a selected portion of the deposit to a temperature sufficient to vaporize or gasify at least some of the hydrocarbons located in the selected portion and then collecting the vaporized or gasified hydrocarbons. By "hydrocarbon" is meant one or more of the constituents of naturally-occurring deposits of petroleum, kerogen, lignite, etc. composed of the elements hydrogen and carbon, sometimes with the addition of other elements.

The heating is preferably effected substantially uniformly (within economical limitations) throughout the selected portion of the deposit. This enables all portions of the deposit to yield the same fractions of the deposited hydrocarbons at or about the same period of time, thereby tending to avoid, for example, the problem that a portion of the deposit would be coking while another portion would be vaporizing lighter fractions at relatively low temperature, while still another portion of the deposit would have been completely exhausted of volatile fractions, leaving spaces through which oxygen could penetrate, creating a burning situation which would be detrimental to recovery of the maximum amount of hydrocarbons. Induction heating of the deposit appears to be the most attractive means of obtaining reasonably uniform heating whilst avoiding combustion of the hydrocarbons. The reader is referred to the applicants' copending patent application Ser. No. 556,545 filed Mar. 10, 1975 and entitled "Induction Heating of Underground Hydrocarbon Deposits", the specification of which is incorporated herein by reference.

In many cases, the hydrocarbon deposit will tend to coke at sufficiently elevated temperatures. The coke, however, in many instances upon further heating will "crack" sufficiently to enable some of the constituent hydrocarbons to be driven off as gaseous or vaporized fractions. (A catalyst may be desirable or necessary to facilitate cracking, and for that purpose may be introduced into the deposit via suitable injection wells.) Thus the light fractions which are vaporized or gasified at a temperature lower than the coking temperature can first be collected from conventional gas or distillate extraction wells, the deposit can then be raised to coking temperature and still further to cracking temperature, and then the additional gaseous or vaporized hydrocarbon fractions can be collected from the same extraction wells.

Throughout the entire process, some of the hydrocarbons may flow as liquids, or may condense from vaporized fractions and may be then recovered from liquid collecting wells.

The invention affords the potential advantage that not only extraction per se but also at least some of the refining process is effected underground, thus tending to make efficient use of the underground heat input and also tending to avoid some of the more serious refining problems that have hitherto faced engineers, among them the problem of separation of suspended clay from the petroleum recovered from bituminous sand beds.

Furthermore, once all fractions are collected that can be driven off following the cracking of the coke, the possibility exists of injecting air into the underground deposit, which will enable the unextractable hydrocarbon residues to be burned, thereby to generate heat. The heat can be recovered for example by heat exchange from the exhaust gases and by injecting water into the hot underground mass and recovering the water in the form of steam, which can then be used to drive turbines for use in the generation of electricity, or used as process steam in subsequent refining stages. Other uses to which such underground heat can be put will occur to those skilled in the art. It should be noted, however, that the underground residues will probably have, in many instances, a high sulphur content, and that burning of the residues will generate sulphur dioxide and possibly other gaseous sulphur-containing compounds, which may not be desirable. Therefore, the final burning stage may be omitted, if desired. Alternatively, the sulphur in the gases may be recovered as elemental sulphur according to known methods.

The present invention can be seen to afford the possibility of extracting not only oil from sands or shale but also hydrocarbons from lignite deposits which hitherto have been, as a practical matter, unavailable to man. The heating of the lignite deposit underground can be effected by means of the same induction heating technique described in applicants' aforementioned patent application Ser. No. 556,545. The lignite, like underground petroleum deposits, will tend to coke at an elevated temperature, and thereafter can be cracked into gaseous or vaporized hydrocarbon fractions which can then be collected in extraction wells essentially similar to those utilized for the extraction of petroleum gases or condensed distillates.

SUMMARY OF THE DRAWINGS

FIG. 1 is a schematic elevation view illustrating a conductive path and associated surface electrical equipment for use in the heating by induction of a selected portion of a bituminous sand deposit or the like.

FIGS. 4 and 5 are schematic perspective views of alternative underground conductive paths for the induction heating of a volume of bituminous sand or the like.

DETAILED DESCRIPTION WITH REFERENCE TO THE DRAWINGS

In the following discussion, reference for the most part will be made to bituminous sand deposits. However, those skilled in the art will recognize that the techniques discussed can be applied, mutatis mutandis, to other types of underground hydrocarbon deposits.

Figure 1:
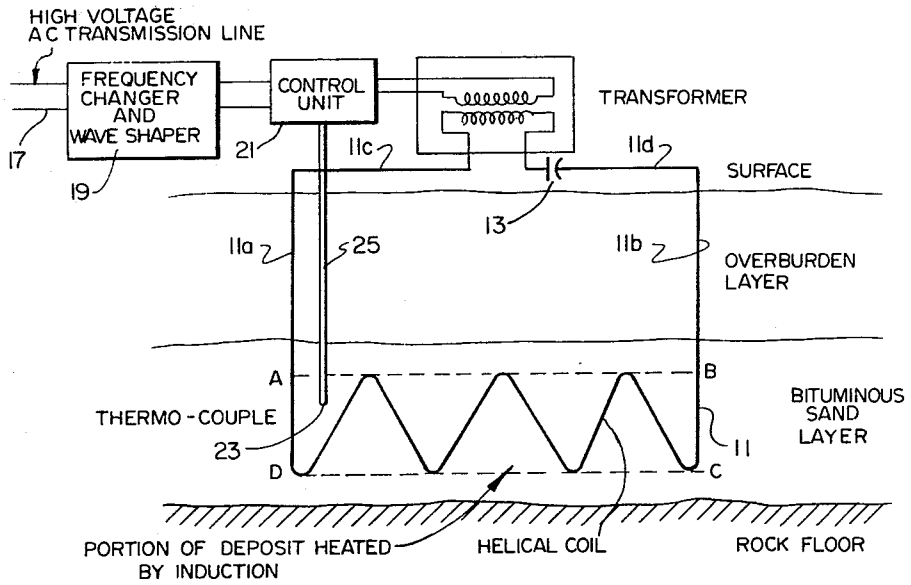

In FIG. 1, a bituminous sand layer is shown located between an overburden layer and a rock floor. Within the bituminous sand layer, an electrical conductor 11 forms a generally helical path substantially encompassing the volume ABCD within the bituminous sand layer. (In the plan view of the same region illustrated schematically in FIG. 2, the same volume is identified by the letters ABEF.) At each end of the helix, the conductor 11 extends vertically upwards to the surface of the ground along paths 11*a*, 11*b* respectively which, when they reach the surface, extend along surface conductors 11*c*, 11*d* respectively to the secondary winding of transformer 15, which should be located as close as possible to the underground conductor in order to minimize surface ohmic losses.

The transformer 15 is a step-down transformer intended to supply a relatively low-voltage high amperage current to the underground conductor 11. Electricity is supplied to the primary winding of transformer 15 from high voltage alternating current transmission lines 17 via frequency changer and wave shaper unit 19 and control unit 21.

A capacitor 13 is connected in series with the helical conductor 11 (which, because of its shape, has appreciable inductance) in order to resonate the conductor 11 at the frequency selected for operation.

It is expected that with experimental testing, the inductive heating effects in the bituminous sand layer will be found to be dependent upon the frequency of alternating current passed through the underground conductor, and also upon the shape of the wave form of the current (and indeed may vary with the temperature and other parameters as the underground mass is heated). For this reason, the frequency changer and wave shaper unit 19 is shown in order that alternating current of the desired frequency and wave shape may be supplied to the underground conductor 11. If, however, experimentation reveals that the frequency and wave shape of the current supplied by the high voltage alternating current transmission line 17 is satisfactory, the frequency changer and wave shaper unit 19 could be omitted and the transmission line 17 connected directly via control unit 21 to the transformer 15. (In North America it would be ordinarily expected that the AC transmission line 17 would carry current having a frequency of 60 Hz. and a sinusoidal wave form.

Control unit 21 is intended to regulate the amount of current supplied by the transformer 15 to the underground conductor 11. It is contemplated that after an appropriate period of time, the temperature of the volume ABCD within the bituminous sand layer will reach that temperature at which an improved flow of petroleum into a collecting well or the like may be expected. Accordingly, a thermocouple 23 suitably located within the volume ABCD and connected by conductive wires 25 to the control unit 21 senses the temperature of the bituminous sand layer generally encompassed by the underground conductor 11. The control unit 21 in its simplest form may be a temperature-responsive switch which closes when the temperature sensed by thermocouple 23 falls below a predetermined low limit and which opens when the temperature sensed by the thermocouple 23 rises above a predetermined high limit.

A cylindrical helical coil configuration is frequently found in industrial induction heating apparatus because within such helix the electromagnetic field is uniform and decreases in intensity outside the coil. Thus if the material located within the volume encompassed by the helix is also uniform, uniform heating can be expected throughout the material. The above is true also of a toroidal coil, and the toroid avoids the end losses associated with a helix. If the economics of the situation warrant it, a torrid (or simulated toroid) could be used instead of a helix.

The rate of absorption of energy from the helical conductive path increases with the intensity of the electromagnetic field generated, and also increases with the conductivity of the energy-absorbing material located within the helix. The rate of absorption of energy also increases with increasing frequency, within certain limits. Because of resonance effects, there may also be an optimum frequency for energy absorption for any given conditions, which optimum frequency may conceivably vary over the duration of the heating and extraction processes.

Figure 2:
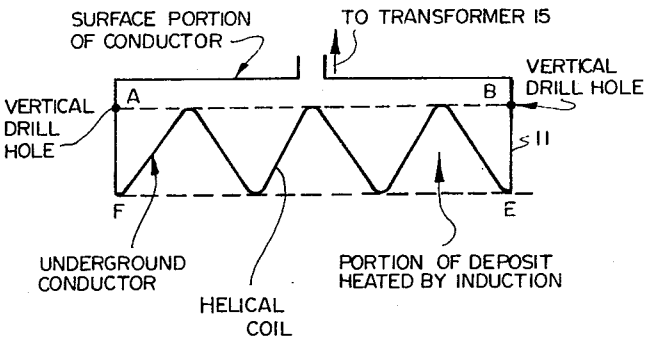
FIG. 2 is a schematic plan view of the conductive path and surface connections therefor illustrated in FIG. 1.
Figure 4:
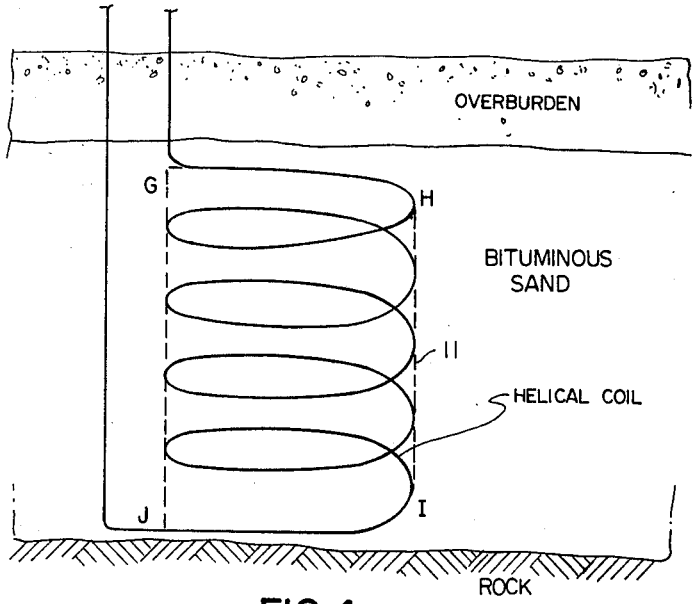

A helix oriented in a direction perpendicular to the orientation of the helix of FIGS. 1 and 2 might perhaps be more easily formed than that of FIGS. 1 and 2; FIG. 4 illustrates such a helical path substantially encompassing and intended to heat by induction the volume GHIJ.

Figure 3:
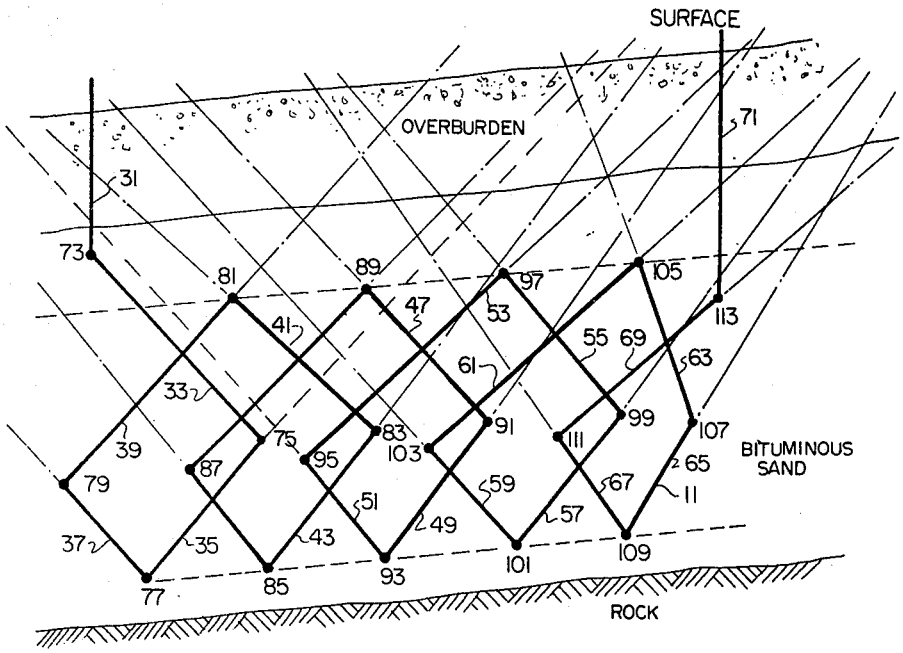
FIG. 3 is a schematic view illustrating a pattern of straight-line drill holes so located as to enable the simulation of the conductive path of FIG. 1.

In any event, the helix of FIGS. 1 and 2 may be simulated by a number of interconnected straight-line conductive paths which can be formed in the manner illustrated by FIG. 3. The conductive paths of FIG. 3 are formed in interconnected straight-line drill holes. Vertical drill holes 31 and 71 are formed. Drill holes 33, 35, 37, 39, 41, 43, 45, 47, 49, 51, 53, 55, 57, 59, 61, 63, 65, 67 and 69 are formed at appropriate angles to the surface to enable these drill holes to intersect with one another and with holes 31 and 71 at points 73, 75, 77, 79, 81, 83, 85, 87, 89, 91, 93, 95, 97, 99, 101, 103, 105, 107, 109, 111 and 113, thereby forming the simulated helical path commencing at point 73 and ending at point 113. Conductors may be located along the appropriate portions (viz., between points of intersection and between the surface and points 73, 113) of the aforementioned drill holes and interconnected at the aforementioned points of intersection so as to form a continuous conductive path beginning with vertical segment 31 and ending with vertical segment 71.

Figure 5:
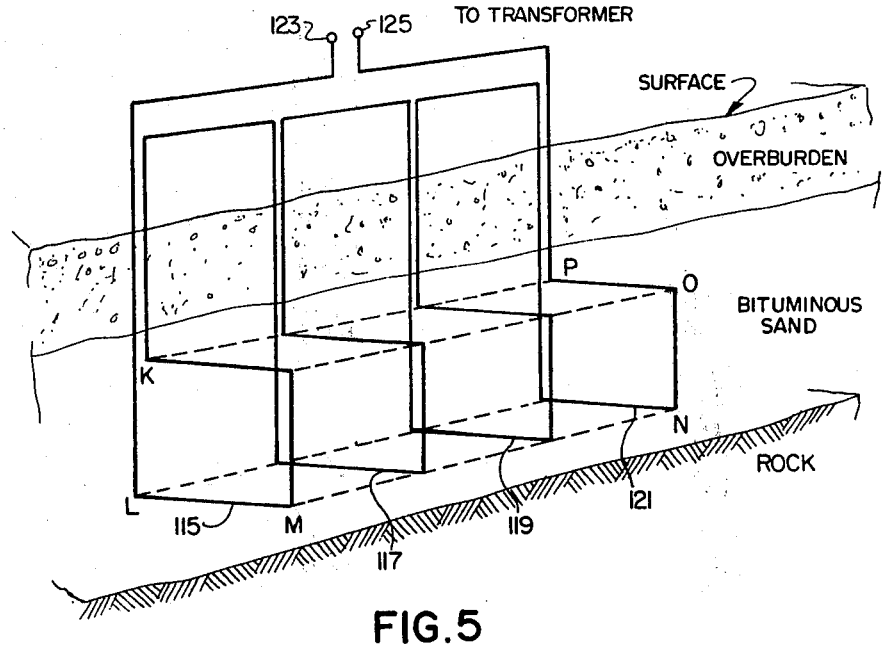

Alternatively, a series of generally rectangular conductive loops may be formed, each loop located within a plane, the planes of the loops being parallel to one another, so as to define an encompassed volume KLMNOP, as illustrated schematically in FIG. 5. These rectangular loops of course will remain open at some point, e.g. at a corner, so as to enable current to flow around the loop. The loops are then surface-connected in the manner illustrated in FIG. 5 to form a continuous circuit from surface terminal 123 to surface terminal 125. Other possible arrangements of interconnected series- or parallel-connected loops will readily occur to those skilled in the art.

Although the simulated helical conductive path of FIG. 3 and other potential configurations that might be employed, such as that of FIG. 5, do not product an electromagnetic field that is entirely uniform within the volume encompassed by the conductive path; nevertheless within reasonable limits the conductive path can be designed so that the electromagnetic field within the volume is sufficiently close to being uniform that the temperature differential between the highest temperature to be found within the encompassed volume and the lowest temperature to be found within the encompassed volume is tolerable.

The thermal conductivity of both the overburden and rock floor defining the upper and lower limits of underground bituminous sand layers in Alberta typically is low in comparison with the thermal conductivity of the bituminous sand. Accordingly, heat losses from the petroleum deposits are expected to be small. Heat loss from the conductor-encompassed volume of bituminous sand will generally be in a transverse direction, to regions of the bituminous sand outside of the volume encompassed by the conductive path. These "losses" can be put to good use if the adjacent volumes of bituminous sand are also inductively heated, so that the "loss" from any one encompassed volume of bituminous sand tends to be useful in raising the temperature of an adjacent encompassed volume of bituminous sand from which petroleum is to be extracted.

Indeed, it is contemplated that an array of inductively-heated volumes of bituminous sand will be processed at any given time, and that a program of continual drilling, conductor disposal, induction heating, and petroleum extraction will expand progressively to adjacent volumes of the petroleum-bearing bituminous sand deposits.

If for any reason it is desired to maintain a particular volume of the bituminous sand at a sustained elevated temperature for a prolonged period of time, the control unit 21 may regulate the current supplied to the underground conductor 11 so as to generate only sufficient eddy current energy within the encompassed bituminous sand volume to compensate for the small heat losses that will occur over a period of time. It is contemplated that only a relatively small expenditure of power will be needed by reason of the low thermal conductivity of the overlying and underlying earth and rock formations.

The bitumen exists naturally at a relatively low temperature at which it is very viscous and will not flow appreciably. When the temperature of the bitumen is raised by the induction heating process to a temperature of about 200°F., it has a viscosity of 2 poises, which is roughly the viscosity of SAE 20 motor oil at room temperature. It is possible that at that temperature there may be some flowing of bitumen in a liquid phase into extraction wells which can be conventionally drilled and located throughout the heated portion of the underground bitumen-containing deposit. However, it is anticipated that the mere raising of the temperature to something of the order of 200°F. will not be sufficient to enable a large quantity of the bitumen of reduced viscosity to be extracted. Furthermore, any bitumen available at this temperature would probably still contain suspended clay particles and other contaminants which are undesirable and would have to be extracted from the bitumen in a subsequent refining stage.

Above 200°F., as the heated mass rises in temperature to the boiling point of water, the water film which typically surrounds individual sand particles in the bituminous sand deposits will boil and try to escape in the form of steam. The generation of steam is anticipated to have both a positive effect and a negative effect on the overall extraction process. As a positive effect, the steam will generate pressure within the heated mass, with the result that the flow of bitumen into extraction wells may be promoted because of the pressure effected on the bitumen by the steam. On the other hand, since the water which surrounds the individual quartz sand particles contributes to the relatively high conductivity of the inductively heated mass, the mass would have much lower capability of absorbing energy from the applied electromagnetic field if the water were permitted to escape as steam. This appears to necessitate appropriate compensating measures, such as recycling the steam so as to keep a certain amount of water (in the form of steam) within the heated mass, and it may also be necessary to introduce further conductive materials into the heated mass via injection wells. Such further conductive materials should preferably be in fluid form, either as a gas, liquid or vapor, or as a fine particulate fluid. It may also be necessary to increase the strength of the applied electromagnetic field to compensate for the expected decline in conductivity of the heated mass.

As the mass is heated to about 350°F., some of the lighter fractions of the deposited hydrocarbons will vaporize or gasify and can be distilled off through conventional extraction wells drilled for the purpose of collecting these distilled fractions. The relevant extraction technology is already known to persons skilled in the art. As the temperature continues to rise within the heated mass from 350°F. to approximately 600°F., it is expected that typically at least one half of the available bitumen in the form of lighter fractions will be distilled off as gas or vapor. Above 600°F., it is expected that the bitumen residue would become converted to coke, which is an extremely viscous, almost solid substance. As the temperature of the coke is raised, the coke cracks into gaseous or vapor fractions at about 700°F. Catalysts known in the technology may be injected into the mass through suitable injection wells to promote the coke-cracking process.

Most if not all fractions that can be obtained through the cracking and distilling of the coke can be obtained by heating the mass to no more than 1,000°. At this temperature, it is expected that only approximately 15% of the original bitumen mass would remain within the deposit.

Note that because the temperature of the mass can by induction heating be raised substantially uniformly and steadily from natural temperatures to (say) 1,000°F., the available hydrocarbon fractions will tend to distill off in a regular sequence, and thus the extraction process described above is recognized to be in part a refining process as well. The collected fractions can of course be subjected to further scrubbing, fractionating, etc. in conventional surface refining processes, but it is expected that the petroleum fractions which will have been distilled off and then collected will be found to be free from some of the contaminants, such as the suspended clay, that would be present if the fractions had been collected in liquid phase. Furthermore, the petroleum can be made available at the surface at a relatively high temperature which should thus reduce the amount of input heat that would otherwise be required at the surface to complete the refining of the petroleum.

The user of the above-described process of course has the option of distilling off only the lighter fractions of the entrapped bitumen at temperatures below 600°F. It may for economic reasons be preferable to extract only those lighter fractions and to leave the residue in the ground without going through the coking and cracking process described above. One problem obviously facing the user of the process is the problem of injecting any desired catalysts uniformly through the deposit, and this problem may be sufficiently formidable in the case of at least some underground deposits to deter the use of induction heating of the mass above a temperature of 600°F.

Assuming, however, that in at least some cases the user does crack the coke and obtain the resulting distillate, the 15% residual bitumen appears not to be economically recoverable by further heating alone. It will be appreciated that once the water and most of the bitumen have been removed from the sand, the sand is relatively dry and will permit air under pressure to be blown therethrough. Accordingly, the remaining 15% bitumen can be burned, at a burning temperature of approximately 1400°F. by feeding the formation with air under pressure. This technique, known as "fire flooding" in situ, could conceivably yield further recoverable hydrocarbons; in any event, the heat generated can be put to good use. The hot exhaust gases may be passed to heat exchangers via the same wells which had been used for collecting the distilled fractions previously recovered. After the burning stage, a mass of heated sand remains at approximately 1400°F. The heat loss from the sand to the overburden layers and to the floor is expected to be relatively small because of the very low heat conductivity typical of these layers. Water could be injected via injection wells into the same, and the water recovered in the form of steam which initially would be at a temperature of close to 1400°, but eventually, as more water were pumped into the sand deposit, would decrease in temperature. Nevertheless, this extracted steam could be put to work to drive turbines for the generation of electricity for the electric induction heating process or otherwise, or could be used as process steam in subsequent scrubbing and refining processes on the surface. Other potential uses of the available heat energy will occur to those skilled in the art.

It is expected that an extraction process generally similar to the foregoing can be utilized in association with the oil shale deposits, although since the kerogen in the oil shales is composed of lighter oil fractions, the coking and cracking process would probably not be utilized in connection with the oil shales — most of the kerogen would be expected to distill off without the formation of coke at temperatures under 1,000°F. However, there are obvious problems in the location of wells, etc. in the oil shales that appear to be more formidable than is the case with the bituminous sands of Alberta, since fluid materials are capable of penetrating or flowing through the sands relatively uniformly, and the same cannot necessarily be expected of the shales.

Essentially the same extraction process as described above with reference to bituminous sand deposits can be utilized in association with at least some deposits of underground lignite. The lignite deposits, which constitute the largest part of existing coal reserves, are characterized by the same relatively high conductivity as the underground petroleum deposits in bituminous sands, and therefore the electric induction technique of heating the lignite deposits uniformly to the desired temperature could be employed. As the lignite deposits are heated, it is anticipated that some of the lighter hydrocarbon fractions may distill off before coke is formed, but that a substantial portion will remain as coke which can be cracked, and the hydrocarbon fractions then distilled off in essentially the same manner as described above with reference to the bituminous sands. Again the possibility exists of burning the unextractable residue in situ possibly to yield further hydrocarbons but in any event to generate heat which can be extracted through an appropriate heat exchange method such as the introduction of water and the extraction of the heated water as steam.

Essentially similar extraction techniques may possibly be useful in recovering additional petroleum from previously-worked deposits which have been exhausted by conventional methods.

In some cases, especially in the case of lignite deposits, the extraction of hydrocarbons may create an underground void, which could cause unwanted subsidence. Refinery waste, slurry or water could be pumped into the void, and used as a sink for unwanted low-temperature heat.

Variants of the above-described processes will readily occur to those skilled in the art. The invention is to be construed not as limited by the above specific examples; its scope is as defined in the appended claims.

What is claimed is:

1. A method of extraction and processing in situ of hydrocarbons located in an underground hydrocarbon deposit, comprising:

heating a selected portion of said deposit by means of electric induction heating coils substantially surrounding said selected portion of said deposit to a temperature sufficient to vaporize or gasify at least some of the hydrocarbons located in said selected portion, and collecting the said vaporized or gasified hydrocarbons.

2. A method as defined in claim 1, wherein the selected portion of the deposit is heated to a temperature sufficient to cause cracking of the hydrocarbons into fractions that are distilled off as gases or vapors, and then collected.

3. A method as defined in claim 1, comprising heating the deposit to a temperature sufficient to distill off lighter hydrocarbon fractions, collecting lighter hydrocarbon fractions, heating the deposit to a temperature sufficient to cause coking of residual hydrocarbons in the deposit, heating the deposit further to a temperature sufficient to cause cracking of the coked hydrocarbons, distilling off cracked hydrocarbon fractions, and collecting the cracked hydrocarbon fractions.

4. A method as defined in claim 3, additionally comprising injecting a catalyst into the deposit for facilitating the cracking of the coked hydrocarbons.

5. A method as defined in claim 3, comprising the additional step, following the collecting of the cracked hydrocarbon fractions, of burning in situ the hydrocarbon residue remaining in the said selected portion.

6. A method as defined in claim 5, additionally comprising extracting heat from the deposit during or following the burning step by means of heat exchange, and utilizing the heat thus extracted for the generation of mechanical energy.

7. A method as defined in claim 5, additionally comprising extracting heat from the deposit during or following the burning step by means of heat exchange, and utilizing the heat thus extracted as process heat in the subsequent refining of the collected hydrocarbons.

8. A method as defined in claim 1, wherein the deposit is in its natural state, accompanied by entrapped water, additionally comprising injecting water into the deposit after the temperature of the deposit reaches the boiling point of the entrapped water.

9. A method as defined in claim 8, wherein the water injected into the deposit is injected in the form of steam.

10. A method as defined in claim 1, wherein the deposit comprises bitumen entrapped in sand.

11. A method as defined in claim 1, wherein the deposit comprises kerogen entrapped in shale.

12. A method as defined in claim 1, wherein the deposit comprises lignite.

13. A method of extraction and processing in situ of hydrocarbons located in an underground hydrocarbon deposit, comprising:

heating by electrical induction a selected portion of said deposit to a temperature sufficient to distill off lighter hydrocarbon fractions, collecting lighter hydrocarbon fractions, further heating the deposit by electrical induction to a temperature sufficient to cause coking of residual hydrocarbons in the deposit, further heating the deposit by electrical induction to a temperature sufficient to cause cracking of the coked hydrocarbons, distilling off cracked hydrocarbon fractions collecting the cracked hydrocarbon fractions, burning in situ the hydrocarbon residue remaining in the said selected portion, and extracting heat from the deposit during or following the burning step by means of heat exchange, and utilizing the heat thus extracted as process heat in the subsequent refining of the collected hydrocarbons.

* * * * *